US007452250B2

(12) United States Patent
Yazaki et al.

(10) Patent No.: US 7,452,250 B2
(45) Date of Patent: Nov. 18, 2008

(54) OUTBOARD MOTOR STEERING CONTROL SYSTEM

(75) Inventors: Makoto Yazaki, Wako (JP); Taiichi Otobe, Wako (JP); Hideaki Takada, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 27 days.

(21) Appl. No.: 11/633,912

(22) Filed: Dec. 5, 2006

(65) Prior Publication Data

US 2007/0089661 A1 Apr. 26, 2007

(30) Foreign Application Priority Data

Dec. 10, 2004 (JP) ..... 2004-358809
Dec. 7, 2005 (JP) ..... 2005-353979

(51) Int. Cl.
*B60L 1/14* (2006.01)

(52) U.S. Cl. ..... 440/2; 114/144 RE

(58) Field of Classification Search ..... 440/2; 114/144 R, 144 RE; 340/984, 987
See application file for complete search history.

(56) References Cited

U.S. PATENT DOCUMENTS 5,031,562 A * 7/1991 Nakase et al. ..... 114/150
5,361,024 A * 11/1994 Wisner et al. ..... 318/588
6,116,971 A * 9/2000 Morikami ..... 440/2

FOREIGN PATENT DOCUMENTS

JP 2004-249790 9/2004
JP 2004249791 A * 9/2004

* cited by examiner

*Primary Examiner*—Ed Swinehart
(74) *Attorney, Agent, or Firm*—Carrier, Blackman & Associates, P.C.; Joseph P. Carrier; William D. Blackman

(57) ABSTRACT

An outboard motor steering control system operates at starting of the engine to compare the output of the steering wheel angle sensor which indicates the turned angle of the steering wheel and the output of the rotation angle sensor which indicates the rotation angle of the swivel shaft, determines whether there is a phase difference in steering angle therebetween, responds to any phase difference found by, at the time the boat operator turns the steering wheel, controlling the operation of the actuator connected to the swivel shaft so as to eliminate the difference, and further operates to inform the boat operator of the difference. Owing to this configuration, the difference can be eliminated without causing the boat operator to experience an unnatural feel.

12 Claims, 11 Drawing Sheets

OUTBOARD MOTOR STEERING CONTROL SYSTEM

FIELD OF THE INVENTION

This invention relates to an outboard motor steering control system.

CROSS-REFERENCE TO RELATED APPLICATION

This invention claims priority under 35 USC 119 based on Japanese Patent Application No. 2005-353979, filed on Dec. 7, 2005, the entire disclosure of which is incorporated herein by reference.

DESCRIPTION OF THE RELATED ART

In one common arrangement for steering an outboard motor mounted on a boat, a steering wheel installed in the boat is mechanically connected to a steering mechanism of the outboard motor through a push-pull cable or similar connecting means. When the boat operator turns the steering wheel, the rotational motion of the steering wheel is converted to linear motion that is transmitted to the steering mechanism though the push-pull cable. However, this arrangement does not offer the boat operator a constantly good steering feel because the steering load on the steering wheel varies with the size of the boat and outboard motor and also with the speed of the boat, the sea wave conditions and the like. This inconvenience is still experienced even if the mechanical interconnection is replaced with a hydraulic one.

A new type of steering system that involves no mechanical connection between the steering wheel and the outboard motor steering mechanism has recently been developed for overcoming this problem. In this system, an actuator is connected to the steering shaft of the outboard motor and a rotation angle sensor is installed near the actuator to detect the angle of rotation of the steering shaft, and a steering wheel angle sensor is installed near the steering wheel for detecting its turned angle. The operation of the actuator is controlled to eliminate the deviation between the detected turned angle and rotation angle. A typical steering system of this type is set out in Japanese Laid-Open Patent Application No. 2004-249790 (particularly paragraph 0036).

SUMMARY OF THE INVENTION

In a system such as that of the reference which drives the steering shaft with an actuator, a phase difference may arise between the steered angles or positions of the steering wheel and steering shaft on certain occasions, particularly at the time of starting the engine of the outboard motor. This phase difference has to be eliminated by a correction on one side or the other, for instance by correcting the angle of the steering shaft of the outboard motor. If the correction is made without taking the intention of the boat operator into account, the boat operator is likely to experience an unnatural feel. This is because the boat operator who has previously used mechanical and hydraulic systems is accustomed to conducting all steering operations by himself. When he encounters a system that steers through the intermediation of an actuator, he experiences an unnatural feel if the actuator steers the outboard motor independently of his desire.

An object of this invention is therefore to overcome this inconvenience by providing an improved steering control system for an outboard motor that is equipped with an internal combustion engine and a propeller driven by the engine and is steered by operating an actuator connected to a steering shaft of the outboard motor in accordance with the turning of a steering wheel of the boat on which the outboard motor is mounted, that can eliminate a phase difference between the angles or positions of the steering wheel and the steering shaft occurred for example at engine starting, without giving the boat operator an unnatural feel.

In order to achieve the object, this invention provides a system for controlling steering an outboard motor adapted to be mounted on a stern of a boat and having an internal combustion engine that powers a propeller, comprising: a steering wheel installed at a cockpit of the boat to be turned by an operator; an actuator that rotates the outboard motor about a steering shaft in response to turning of the steering wheel such that the outboard motor is steered relative to the boat; a steering wheel angle sensor which produces an output indicative of a turned angle of the steering wheel; a rotation angle sensor which produces an output indicative of a rotation angle of the steering shaft; and a controller which compares the outputs of the steering wheel angle sensor and the rotation angle sensor to determine whether there is a phase difference in steering angle when the engine is started, controls operation of the actuator so as to eliminate the difference, if the phase difference is found, when the operator turns the steering wheel, and informs the operator of the phase difference.

BRIEF DESCRIPTION OF THE DRAWINGS

The above and other objects and advantages of the invention will be more apparent from the following description and drawings in which:

FIG. 11 are a set of views showing the informing operation by the indicator shown in FIG. 9 and the like;

DETAILED DESCRIPTION OF THE PREFERRED EMBODIMENTS

An outboard motor steering control system according to preferred embodiments of the present invention will now be explained with reference to the attached drawings.

Figure 1:
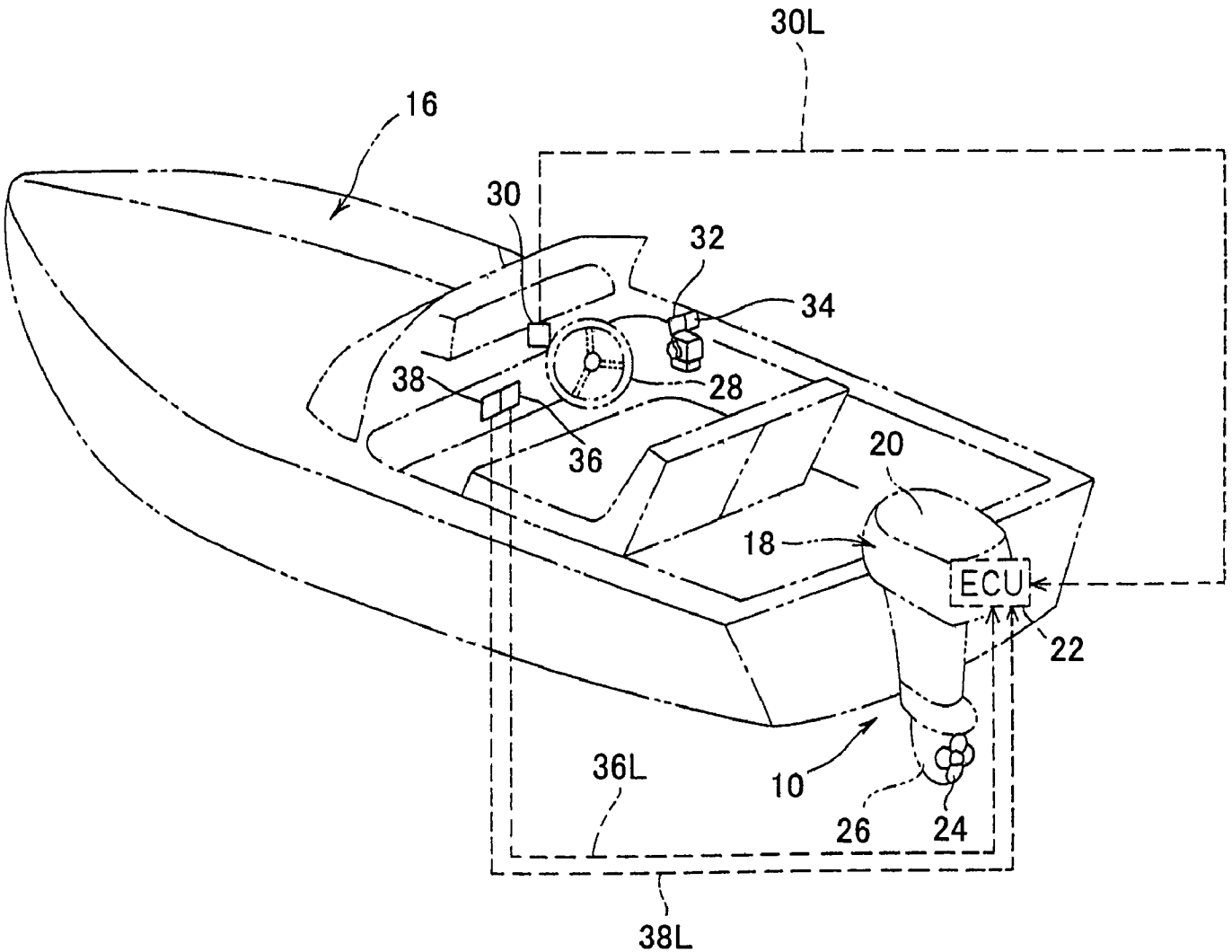
FIG. 1 is an overall schematic view of an outboard motor steering control system according to a first embodiment of the invention.
Figure 2:
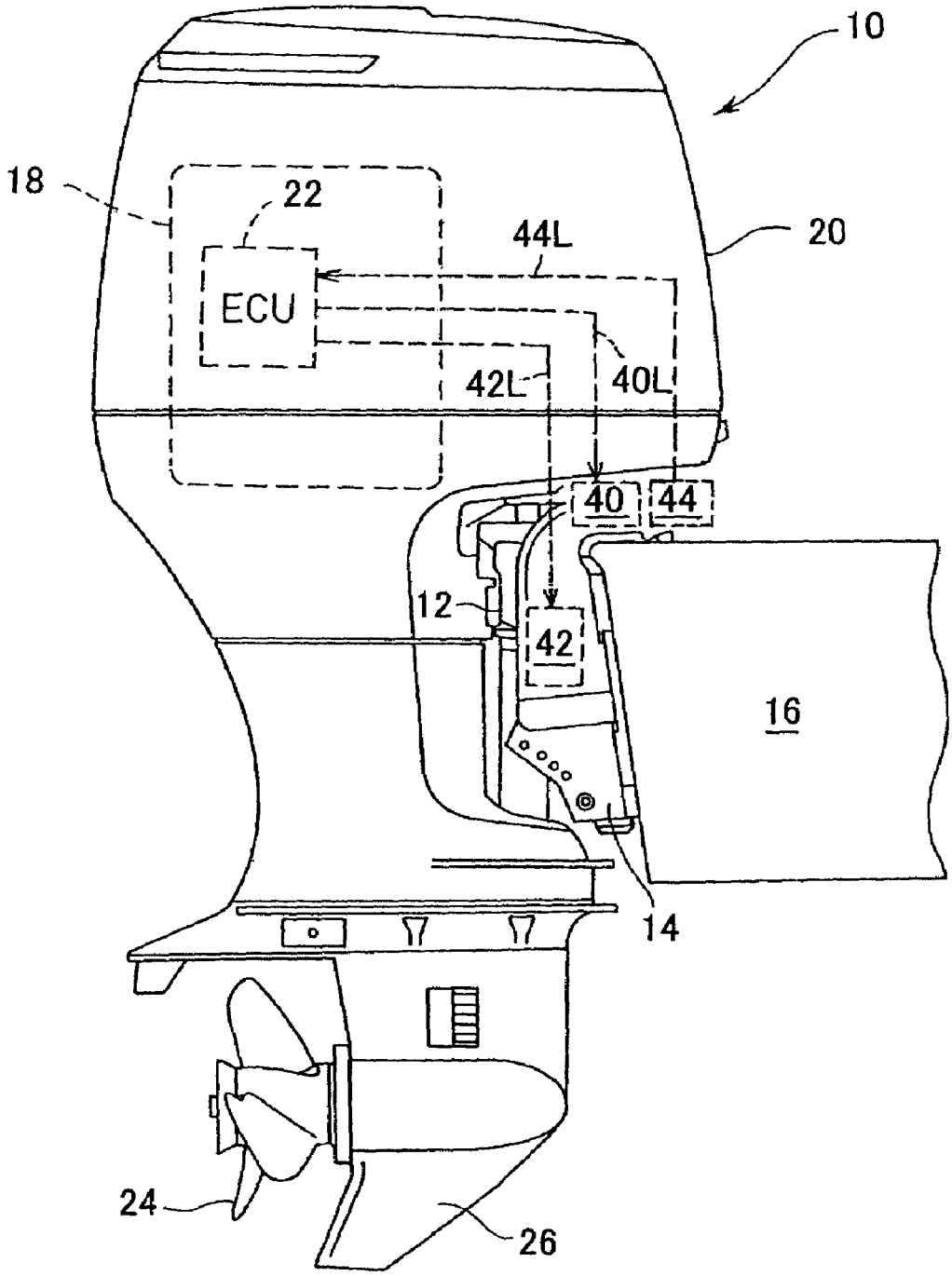
FIG. 2 is a partial side view of the system shown in FIG. 1.

FIG. 1 is an overall schematic view of an outboard motor steering control system according to a first embodiment of the invention and FIG. 2 is a partial side view of the system.

In FIGS. 1 and 2, reference numeral 10 indicates an outboard motor that integrally comprises an internal combustion engine, propeller shaft, propeller and the other components. As shown in FIG. 2, the outboard motor 10 is fastened to the stern of a boat or hull 16 to be freely steered about the vertical axis and horizontal axis through a swivel case 12 housing a swivel shaft (explained later) that is freely rotated therein and stern brackets 14 connected to the swivel case 16.

The internal combustion engine (hereinafter referred to as the "engine"; now assigned by reference numeral 18) is disposed at the upper portion of the outboard motor 10. The engine 18 comprises a spark-ignition, in-line, four-cylinder, four-cycle gasoline engine with a displacement of 2,200 cc. The engine 18 is located above the water surface and enclosed by an engine cover 20 in the outboard motor 10. An electronic control unit (ECU) 22 comprising a microcomputer is disposed near the engine 18 covered by the engine cover 20.

The outboard motor 10 is installed with the propeller (now assigned by reference numeral 24) at its lower portion and a rudder 26 disposed in the vicinity thereof. The propeller 24 is driven by the power of the engine 18 whose output is transmitted via a crankshaft, drive shaft, gear mechanism and shift mechanism (none of which is shown), thereby propelling the boat 16 to move in the forward or reverse direction.

As shown in FIG. 1, a steering wheel 28 is installed near a cockpit (operator's seat) of the boat 16. A steering wheel angle sensor 30 is installed near the steering wheel 28. Specifically, the steering wheel angle sensor 30 comprises a rotary encoder and produces an output or signal in response to the turned angle or amount of the steering wheel 28 manipulated by the operator. A throttle lever 32 and a shift lever 34 are installed on the right side of the cockpit and the manipulation thereof is transmitted through push-pull cables (not shown) to a throttle valve (not shown) of the engine 18 and to the shift mechanism (not shown).

A power tilt switch 36 for regulating the tilt angle of the outboard motor 10 and a power trim switch 38 for regulating the trim angle thereof are also installed near the cockpit and produce outputs or signals in response to up/down instructions of tilt/trim angle inputted by the operator. The outputs of the steering wheel angle sensor 30, power tilt switch 36 and power trim switch 38 are sent to the ECU 22 through signal lines 30L, 36L and 38L.

As shown in FIG. 2, a steering actuator, i.e., a hydraulic cylinder 40 (hereinafter called "steering hydraulic cylinder") and a known power tilt-trim unit 42 for regulating the tilt/trim angle are installed near the swivel case 12 and stern brackets 14 and are connected to the ECU 22 through signal lines 40L and 42L. A rotation angle sensor 44 is installed near the steering hydraulic cylinder 40 and produces an output or signal in response to the rotation angle of the swivel shaft (explained later) housed in the swivel case 12. The output of the rotation angle sensor 44 is sent to the ECU 22 through a signal line 44L.

Based on the outputs of the foregoing sensors and switches, the ECU 22 drives the steering hydraulic cylinder 40 to steer the outboard motor 10 and operates the power tilt-trim unit 42 to regulate the tilt angle and trim angle of the outboard motor 10.

Figure 3:
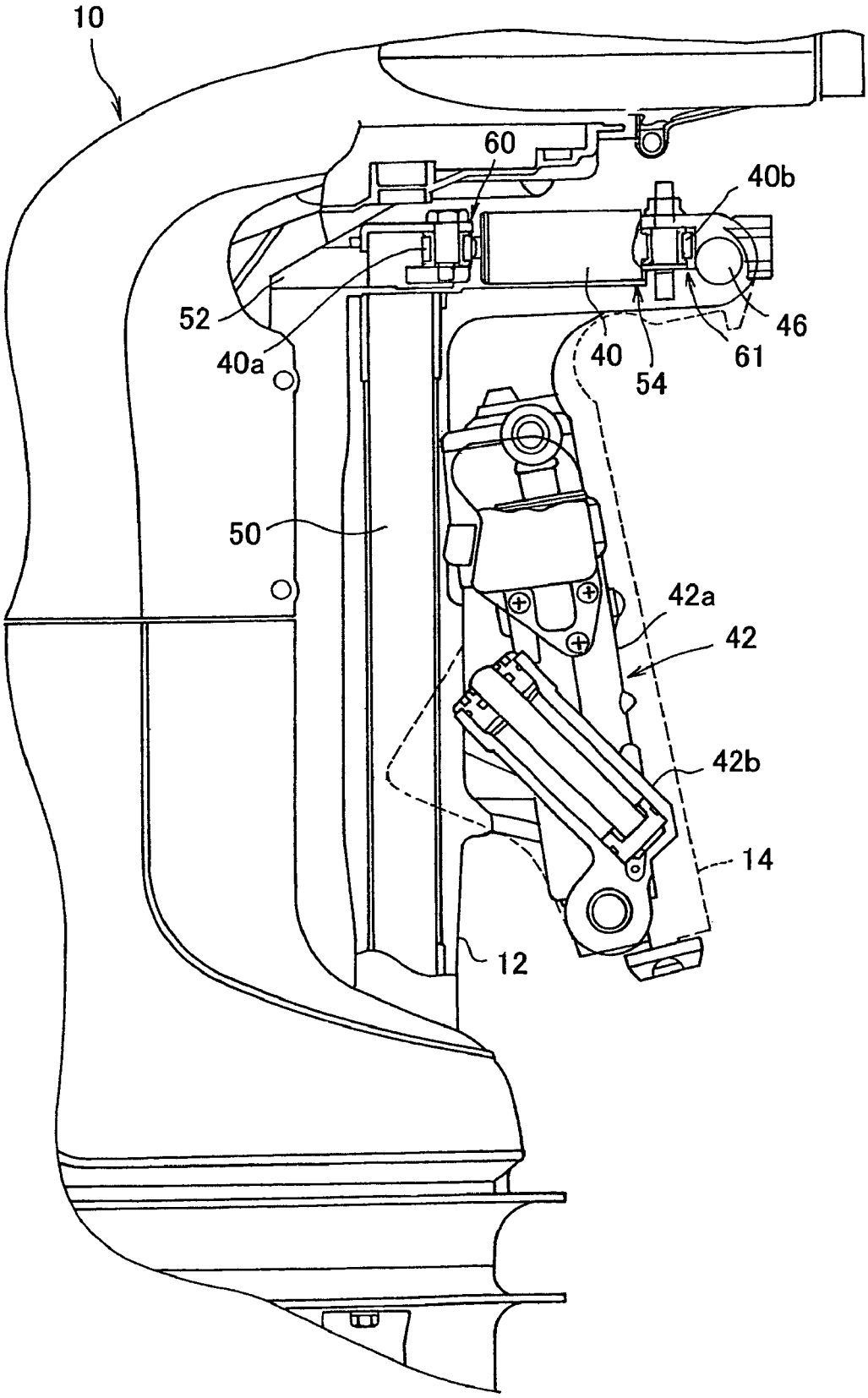
FIG. 3 is an enlarged partial sectional view showing the vicinity of a swivel case shown in FIG. 2.

FIG. 3 is an enlarged partial sectional view showing the vicinity of the swivel case 12 shown in FIG. 2.

As shown in FIG. 3, the power tilt-trim unit 42 integrally comprises a hydraulic cylinder for adjusting the tilt angle (hereinafter called the "tilt hydraulic cylinder") 42*a*, and two hydraulic cylinders for adjusting the trim angle (only one shown; hereinafter called the "trim hydraulic cylinder") 42*b*.

A cylinder bottom of the tilt hydraulic cylinder 42*a* is fastened to the stern brackets 14 to be attached to the boat 16 and a rod head of the piston rod abuts on the swivel case 12. A cylinder bottom of each trim hydraulic cylinder 42*b* is fastened to the stern brackets 14 to be attached to the boat 16 and a rod head of the piston rod abuts on the swivel case 12.

The swivel case 12 is connected to the stern brackets 14 through a tilting shaft 46 such that its relative angle can be freely displaced about the tilting shaft 46. The swivel shaft (now assigned by reference numeral 50) is housed in the swivel case 12 to be freely rotated therein. The axis of the swivel shaft 50 extends in the vertical direction. The upper end of the axis is fastened to a mount frame 52 and the lower end thereof is fastened to a lower mount center housing (not shown), i.e., a shaft member of the mount frame 52 constitutes the swivel shaft 50. The mount frame 52 and lower mount center housing are fixed to a frame that is installed with the engine 18, propeller 24 and the like.

Figure 4:
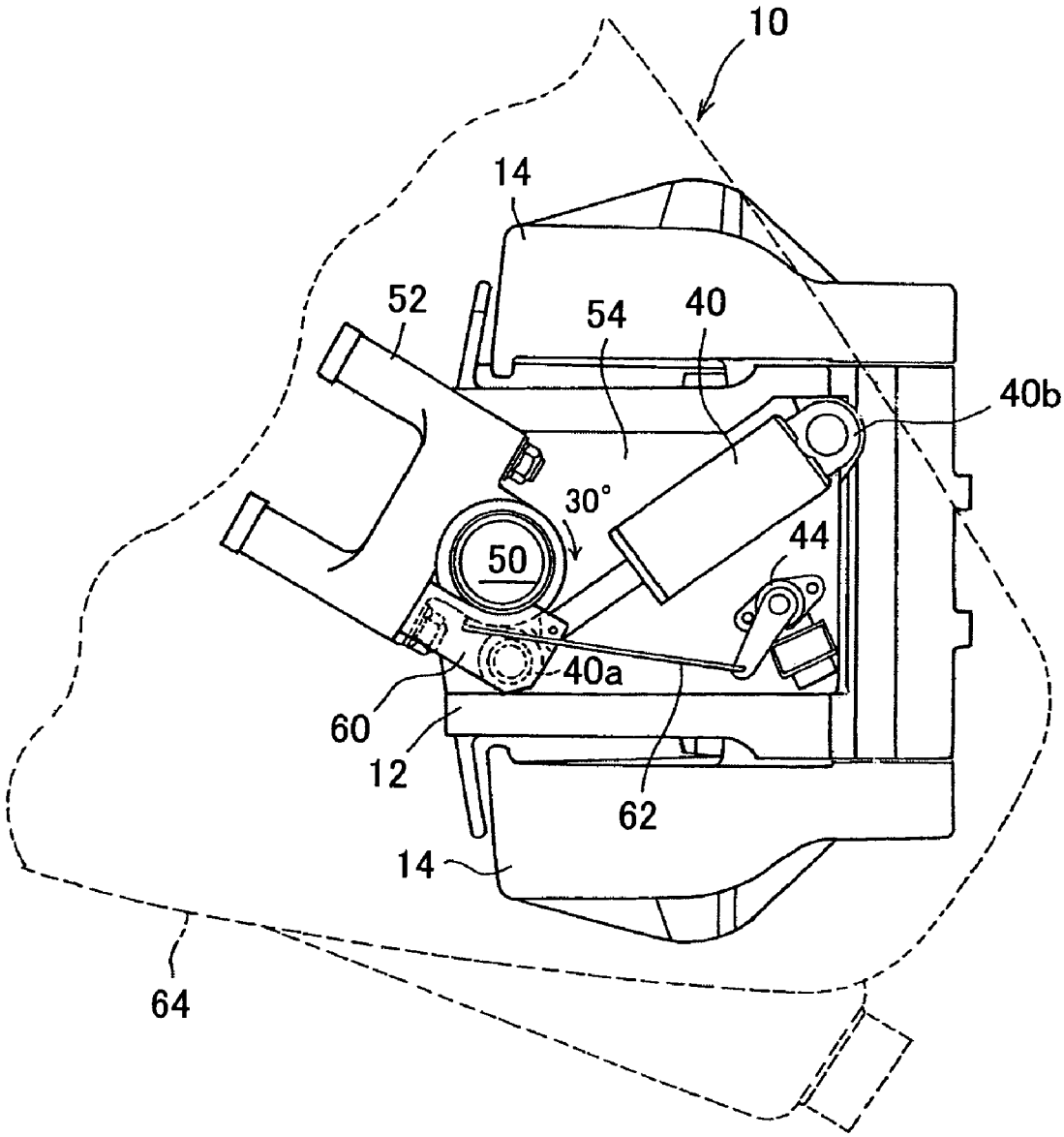
FIG. 4 is a plane view showing the vicinity of the swivel case as viewed from the top when the outboard motor shown in FIG. 1 is steered clockwise to the maximum steering angle.

FIG. 4 is a plane view showing the vicinity of the swivel case 12 viewed from the top.

As shown in FIGS. 3 and 4, the swivel case 12 is formed at its upper portion with a recess 54 in a depressed or hollowed shape when viewed in cross-section. The steering hydraulic cylinder 40 is disposed in the interior space of the recess 54. The steering hydraulic cylinder 40 comprises a double-acting cylinder and is connected to a hydraulic pump (not shown) through two oil paths (not shown) to be supplied with hydraulic pressure.

The rod head 40*a* of the steering hydraulic cylinder 40 is attached to the mount frame 52 (a portion where angle displacement in terms of the steering angle, i.e., angle of the outboard motor 10 relative to the boat 16 is generated in the horizontal direction with respect to the long axis of the boat 16) with support by a stay 60, and the cylinder bottom 40*b* thereof is attached to the swivel case 12 (a portion where the angle displacement is not generated in the horizontal direction with respect to the long axis of the boat 16) with support by a stay 61 positioned on the outboard motor main body side, while disposed in the interior space of the recess 54.

As shown in FIG. 4, the rotation angle sensor 44 is installed in the interior space of the recess 54 and connected to the stay 60 through a sensor rod 62. Specifically, the rotation angle of the swivel shaft 50 is transmitted through the mount frame 52, stay 60 and sensor rod 62 to the rotation angle sensor 44 and is detected by the rotation angle sensor 44.

Based on the foregoing, the steering operation of the outboard motor 10 will be briefly explained.

When the operator turns the steering wheel 28, the turned steered angle is inputted to the ECU 22 through the steering wheel angle sensor 30. The ECU 22 operates the hydraulic pump to drive (extend and contract) the steering hydraulic cylinder 40, thereby rotating the swivel shaft 50 to steer the outboard motor 10, such that a difference between the turned angle of the steering wheel 28 detected by the steering wheel angle sensor 30 and the rotation angle of the swivel shaft 50 detected by the rotation angle sensor 44 decreases to zero in terms of the steering angle, i.e., angle of the outboard motor 10 relative to the boat 16.

Thus the operation of the steering hydraulic cylinder 40 power-assists the steering of the outboard motor 10 about the steering shaft, i.e., swivel shaft 50, in the horizontal direction, thereby turning the propeller 24 and rudder 26 to steer the boat 16. Specifically, when the steering hydraulic cylinder 40 is driven in the extending direction, as shown in FIG. 4, the swivel shaft 50 and mount frame 52 are rotated clockwise, i.e., clockwise as viewed from the top with respect to the boat 16 such that the outboard motor 10 is turned clockwise, thereby steering the boat 16 counterclockwise, i.e., counterclockwise as viewed from the top.

Figure 5:
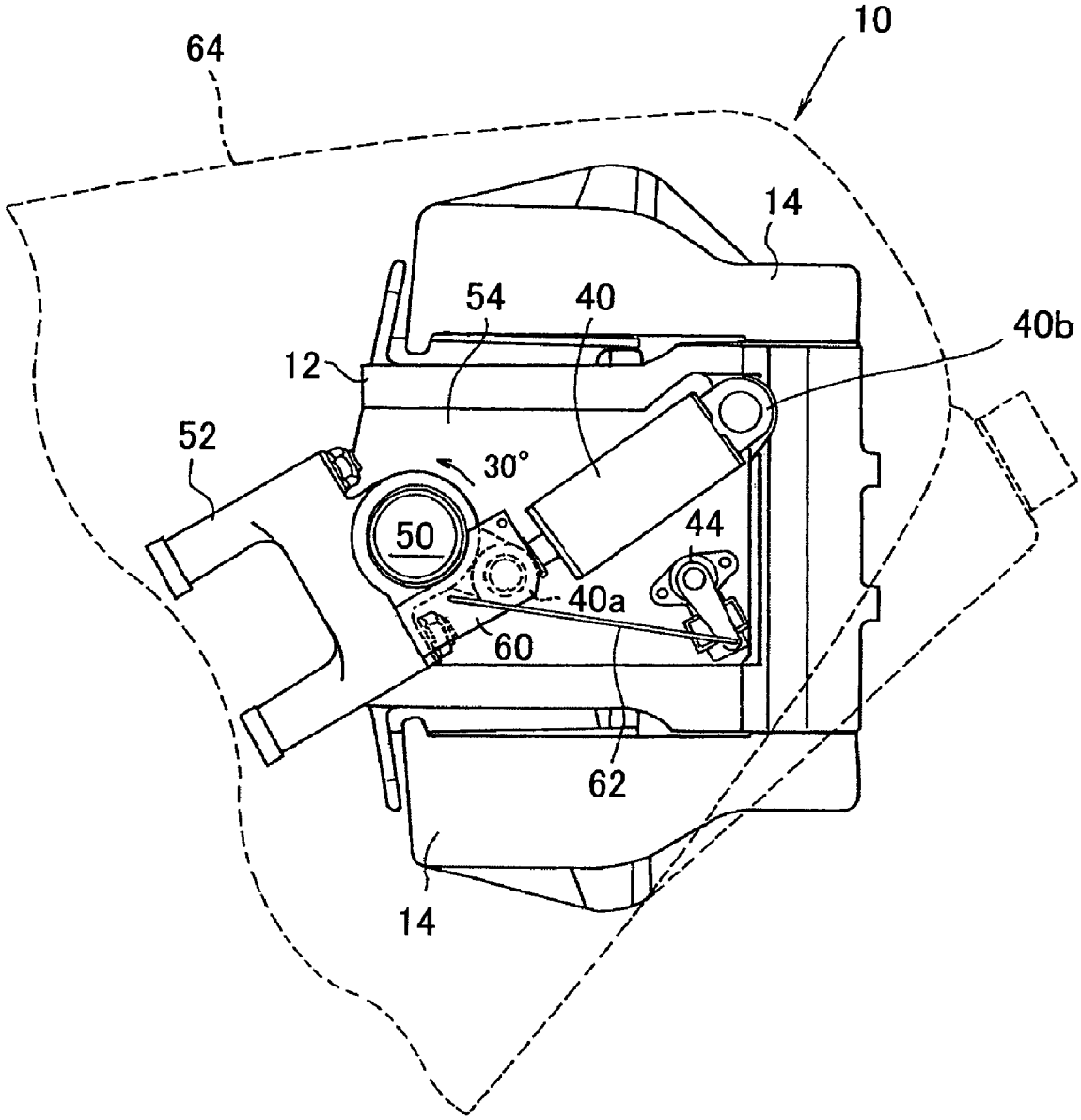
FIG. 5 is a plane view similar to FIG. 4 but showing the vicinity of the swivel case as viewed from the top when the outboard motor shown in FIG. 1 is steered counterclockwise to the maximum steering angle.

On the other hand, when the steering hydraulic cylinder 40 is driven in the contracting direction, as shown in FIG. 5, the swivel shaft 50 and mount frame 52 are rotated counterclockwise with respect to the boat 16 such that the outboard motor 10 is turned counterclockwise, thereby steering the boat 16 clockwise.

In FIGS. 4 and 5, reference numeral 64 indicates an outline or profile (projected in the vertical plane) of the outboard motor 10 as viewed from the top. Specifically, FIG. 4 is a plane view showing the vicinity of the swivel case 12 as viewed from the top when the outboard motor 10 is steered clockwise to the maximum steering angle, i.e., 30 degrees, and FIG. 5 is a plane view showing the vicinity of the swivel case 12 as viewed from the top when the outboard motor 10 is steered counterclockwise to the maximum steering angle, i.e., 30 degrees. It should be noted that, in FIGS. 4 and 5, part of the structure is illustrated in a simplified manner for clearly showing the movement of the steering hydraulic cylinder 40.

The structure in the vicinity of the steering wheel 28 will now be explained.

Figure 6:
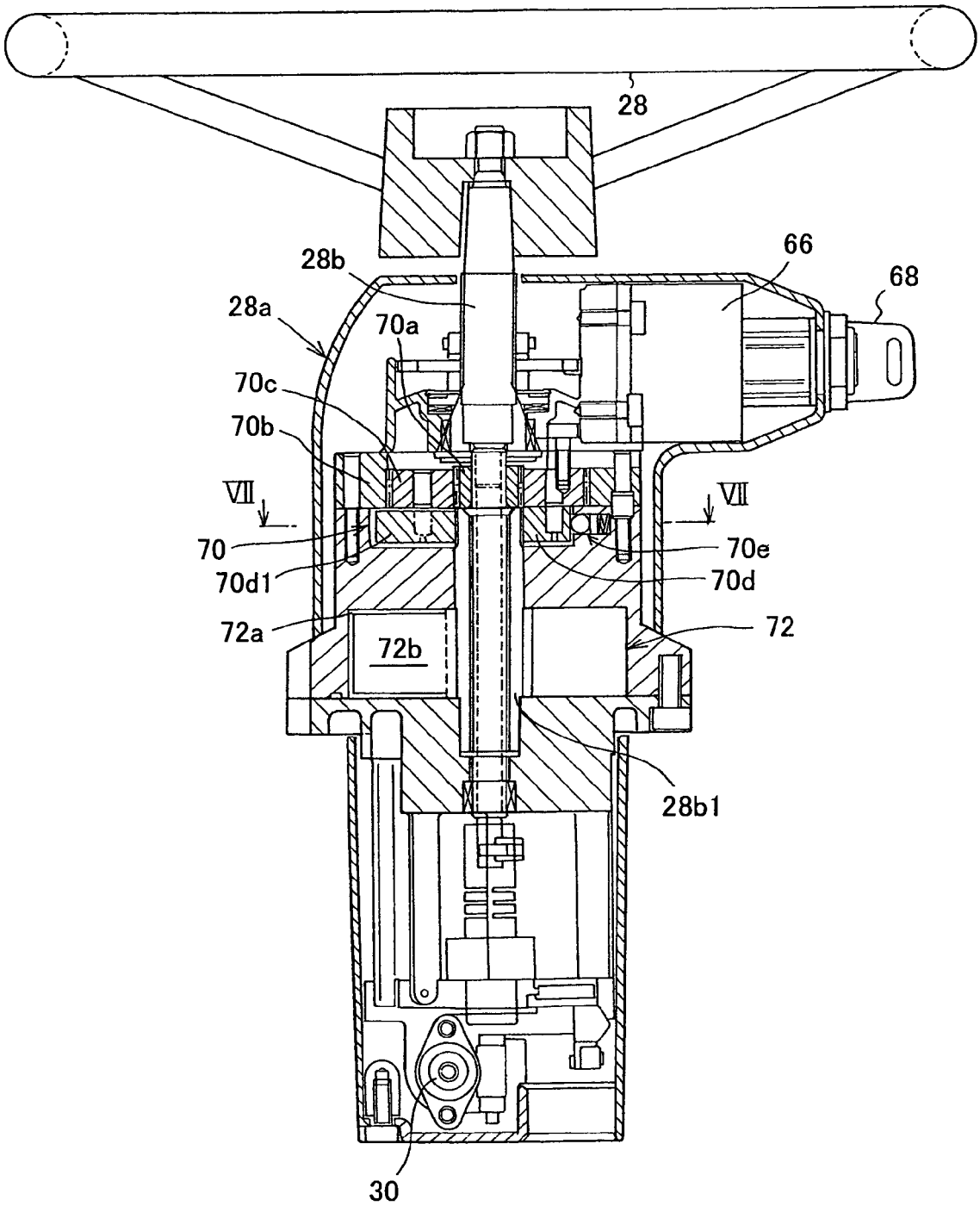
FIG. 6 is a longitudinal sectional view showing the structure of a column unit of a steering wheel shown in FIG. 1 in detail.
Figure 7:
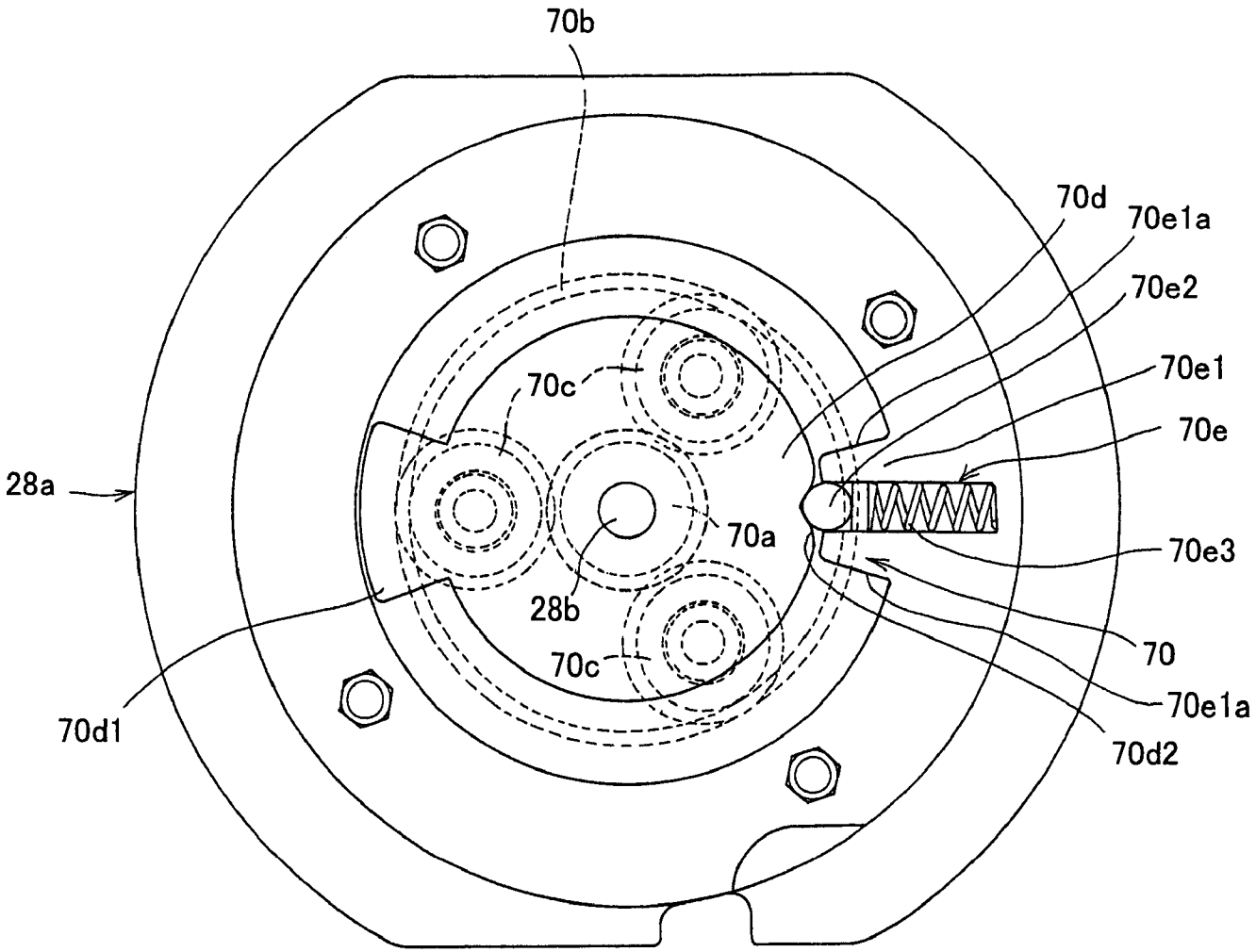
FIG. 7 is an enlarged cross-sectional view taken along line VII-VII in FIG. 6.

FIG. 6 is a longitudinal sectional view of a column unit 28*a* of the steering wheel 28, and FIG. 7 is an enlarged cross-sectional view taken along line VII-VII in FIG. 6.

A steering shaft 28*b* fastened to the steering wheel 28 extends downward through the column unit 28*a*. A key unit 66 is installed in the column unit 28*a* near the steering wheel 28. The boat operator starts the engine 18 by inserting an ignition key 68 into the key unit 66 and turning it to supply power from a battery (not shown) to the engine 18 through a power circuit (not shown).

A neutral position detector 70 comprising a planetary gear mechanism and a detent mechanism is installed on the steering shaft 28*b* at a location downward from the key unit 66.

When the boat operator turns the steering wheel 28, the neutral position detector 70 detects the center of the full (lock-to-lock) steering angle range as the neutral position. The full steering angle range of the steering wheel 28 is three turns (1.5 turns in either direction).

The structure of the neutral position detector 70 will be explained with reference also to FIG. 7. The planetary gear mechanism of the neutral position detector 70 comprises a sun gear 70*a* fastened to the steering shaft 28*b*, an internal gear 70*b* fastened to the column unit 28*a*, three planetary pinions 70*c* that revolve around the sun gear 70*a* in engagement with the sun gear 70*a* and the internal gear 70*b*, and a carrier 70*d* to which the three planetary pinions 70*c* are attached. As shown in FIGS. 6 and 7, the carrier 70*d* has the general shape of a disk.

A stop (projection) 70*d*1 is formed on the outer periphery of the carrier 70*d*, and an arcuate indentation (concavity) 70*d*2 is formed thereon at a location diametrically opposite from the stop 70*d*1. A presser 70*e* is disposed at the indentation 70*d*2. The presser 70*e* comprises a case 70*e*1, a roller 70*e*2 movably fitted inside the case 70*e*1, and a spring 70*e*3. The spring 70*e*3 of the presser 70*e* constantly presses the roller 70*e*2 against the carrier 70*d*, so that the presser 70*e* maintains a load on the carrier 70*d* by pressing onto the periphery thereof. The aforesaid detent mechanism is constituted by the presser 70*e* and the indentation 70*d*2.

Owing to the foregoing configuration of the neutral position detector 70, the steering wheel 28, more exactly the steering shaft 28*b*, is connected to a reduction gear mechanism composed of the sun gear 70*a*, the internal gear 70*b* and the planetary pinions 70*c*. This reduction gear mechanism reduces the boat operator's rotation of the steering wheel 28 to about ¼ before transmitting it to the carrier 70*d* connected to the reduction gear mechanism. Therefore, when, for example, the steering wheel 28 is rotated three full turns away from its left or right steering limit, the carrier 70*d* makes a ¾ turn (290 degree turn to be exact), at which point the stop 70*d*1 strikes against one edge 70*e*1*a* of the case 70*e*1 of the presser 70*e* to lock (stop further rotation of) the steering wheel 28.

Owing to the fact that the spring 70*e*3 keeps the roller 70*e*2 of the presser 70*e* constantly pressed against the carrier 70*d*, the boat operator feels the steering wheel load change near the turned angle where the roller 70*e*2 enters the indentation 70*d*2. Therefore, if the indentation 70*d*2 is formed at the neutral steering position of the steering wheel 28 and the presser 70*e* is located at this position, and, in addition, the stop 70*d*1 is formed at the most distant position therefrom (diametrically opposite therefrom as shown in FIG. 7), the boat operator will be able to tell when the steering wheel 28 passes through the neutral position at the middle (center) of lock-to-lock steering range as it rotates to the left or right.

The explanation of FIG. 6 will be resumed. A hydraulic damper 72 is provided on the steering shaft 28*b* below the end of the neutral position detector 70 as viewed in the drawing. The hydraulic damper 72 comprises a chamber 72*a* of circular shape in plan view (as viewed in the axial direction of the steering shaft 28*b*) that is formed in the column unit 28*a* to surround the steering shaft 28*b*, a vane 72*b* attached to the steering shaft 28*b* (more exactly to a jacket 28*b*1 sleeved on the outer periphery thereof) to project in the radial direction, and lubricating oil (operating oil) contained in the chamber 72*a*.

When the boat operator turns the steering shaft 28*b*, the resulting movement of the vane 72*b* of the hydraulic damper 72 through the lubricating oil contained in the chamber 72*a* is resisted in proportion to the amount (pressure) of the lubricating oil charged in the chamber 72*a*. So, by appropriately defining the oil pressure of the chamber 72*a*, it is possible to suitably damp the turning of the steering wheel 28 and thus upgrade the steering feel.

The steering wheel angle sensor 30 constituted by the aforesaid rotary encoder is installed near tip of the steering shaft 28*b* at a point beyond the hydraulic damper 72. The turning of the steering shaft 28*b* is transmitted through a worm gear (not shown) to the steering wheel angle sensor 30, which produces an output proportional to the amount of turning of the steering shaft 28*b* and thus to that of the steering wheel 28. As mentioned earlier, the output of the steering wheel angle sensor 30 is sent to the ECU 22.

The operation of the outboard motor steering control system according to this embodiment will now be explained.

The operation of the system is implemented by ECU 22 when the engine 18 is started as to eliminate any steering angle phase difference (steering angle deviation) between the turned angle (or position) of the steering wheel 28 detected by the steering wheel angle sensor 30 and the rotation angle (or position) of the swivel shaft (steering shaft) 50 detected by the rotation angle sensor 44, without giving the boat operator an unnatural feel.

Figure 8:
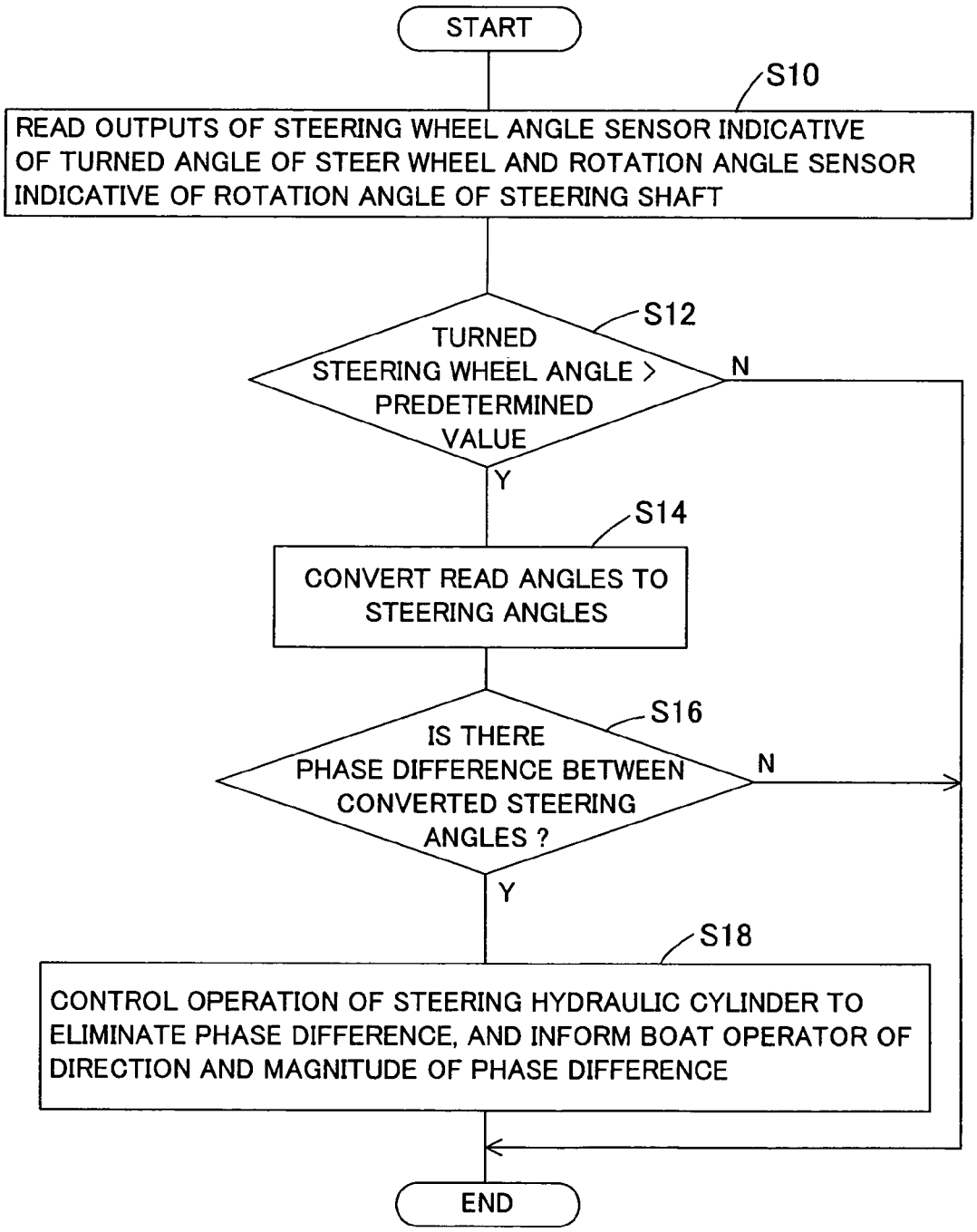
FIG. 8 is a flowchart showing the operation of the system according to the embodiment.

FIG. 8 is a flowchart showing the flow of the operation. The program represented by the flowchart is executed only once at starting of the engine 18.

In S10, the outputs (detection values) of the steering wheel angle sensor 30 and rotation angle sensor 44 are read. Next, in S12, it is determined whether the read (detected) turned angle of the steering wheel 28 exceeds a predetermined value (e.g., 0 degree) in either the positive or negative direction. This amounts to determining whether the boat operator has performed steering (turned the steering wheel 28). In this explanation, clockwise turning of the steering wheel 28 is defined as positive and counterclockwise turning as negative.

When the result in S12 is NO, the remaining steps of the program are skipped. This is the avoid the aforesaid unnatural feel the boat operator is apt to be given should phase difference be eliminated (corrected) independently of the desire of the boat operator in the case where the swivel shaft (steering shaft) 50 is driven by the steering hydraulic cylinder (actuator) 40. The steps for eliminating phase difference are therefore executed when the boat operator performs steering.

When the result in S12 is YES, the program goes to S14, in which the read turned angle and rotation angle outputs are converted to steering angles. "Steering angle" is defined here to mean the angle (orientation) of the outboard motor 10 with respect to the longitudinal axis of the boat. In line with the sign of the turned angle of the steering wheel 28, steering of the outboard motor 10 clockwise (from the viewpoint of the boat operator) relative to the longitudinal axis of the boat 16 is defined as positive and steering in the opposite direction as negative.

Next, in S16, it is determined whether there is a difference between the converted steering angles, i.e., the phase difference (in steering angle). Thus at starting of the engine 18 a determination is made as to whether the steering angle phase difference is present between the outputs of the steering wheel angle sensor 30 and rotation angle sensor 44.

When the result in S16 is NO, the remaining step of the program is skipped. When it is YES, the program goes to S18, in which the operation of the steering hydraulic cylinder 40 is controlled for rotating the swivel shaft 50, i.e., the phase difference elimination control is performed so as to eliminate the phase difference. Simultaneously, the boat operator is continually kept visually informed of the phase difference following engine starting, specifically of the direction (orientation) of the phase difference and the magnitude of the phase difference.

The manner in which the phase difference (if any) is displayed will be explained with reference to FIGS. 9 to 11. As shown in the drawings, an indicator 74 is provided near the steering wheel 28. The indicator 74 comprises two lamps 74*a*, 74*b*, as seen in FIG. 11. The lamps 74*a*, 74*b* are light emitting devices such as LEDs or electric bulbs.

Figures 11A, 11B, 11C:
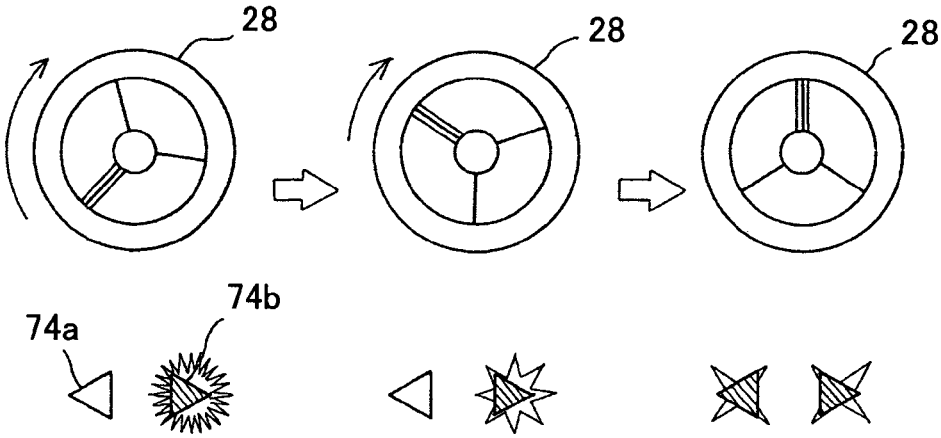

In FIG. 11A, the one of the lamps 74*a*, 74*b* on the side of the phase difference, the right lamp 74*b* in the illustrated example, is shown to be blinking at shorter intervals with increasing phase difference. In FIG. 11B, the blinking intervals are shown to have increased (elongated) in proportion to the decreasing phase difference (the difference is schematically represented by turning of the steering wheel 28). In FIG. 11C, both the left and right lamps 74*a*, 74*b* are shown to be blinking at the same intervals to indicate that the phase difference is or has been eliminated.

Upon completion of the phase difference elimination control executed at engine starting, the ECU 22 switches to the ordinary control mode in which it drives the hydraulic pump to operate (extend or contract) the steering hydraulic cylinder 40 so as to rotate the swivel shaft 50 and steer the outboard motor 10 in a manner that eliminates the deviation between the turned angle of the steering wheel 28 detected by the steering wheel angle sensor 30 and the rotation angle of the swivel shaft 50 detected by the rotation angle sensor 44. Here, it should be noted that the ordinary steering control also falls within the broad definition of phase difference elimination control. In this sense, the control explained with reference to FIG. 8 amounts to initialization processing carried out prior to starting the ordinary steering control.

As set out in the foregoing, the outboard motor steering control system according to this embodiment operates at starting of the engine 18 to compare the output of the steering wheel angle sensor 30, which indicates the turned angle of the steering wheel 28, and the output of the rotation angle sensor 44, which indicates the rotation angle of the swivel shaft (steering shaft) 50, determines whether there is a phase difference in steering angle therebetween, responds to any phase difference found by, at the time the boat operator turns the steering wheel 28, implementing phase difference elimination control for controlling the operation of the steering hydraulic cylinder (actuator) 40 connected to the swivel shaft 50 so as to eliminate the phase difference, and further operates to inform the boat operator of the direction and magnitude of the phase difference. In other words, when there is a phase difference in steering angle between the angles or positions of the steering wheel 28 and swivel shaft 50 at engine starting, then when the boat operator turns the steering wheel 28, phase difference elimination control is performed while simultaneously informing the boat operator of the direction and magnitude of the phase difference. Owing to this configuration, the phase difference can be eliminated without causing the boat operator to experience an unnatural feel.

In addition, the outboard motor steering control system comprises at least one indicator (lamps 74*a*, 74*b*) that blinks to keep the boat operator continually informed of the phase difference. Since this feature enables the boat operator to keep a constant eye on the phase difference by observing a visual display, the phase difference can be eliminated without giving the boat operator an unnatural feel.

Moreover, the outboard motor steering control system enhances steering feel because it is provided in the steering shaft 28*b* with the neutral position detector 70 and the hydraulic damper 72.

FIG. 12 are a set of views, similar to FIG. 11, showing an outboard motor steering control system according to a second embodiment of this invention.

In the outboard motor steering control system according to the second embodiment, the indicator comprise six lamps 74*c* to 74*h*, which are also constituted as light emitting devices such as LEDs or electric bulbs.

The operation of the outboard motor steering control system according to the second embodiment will be explained.

Figures 12A, 12B, 12C:
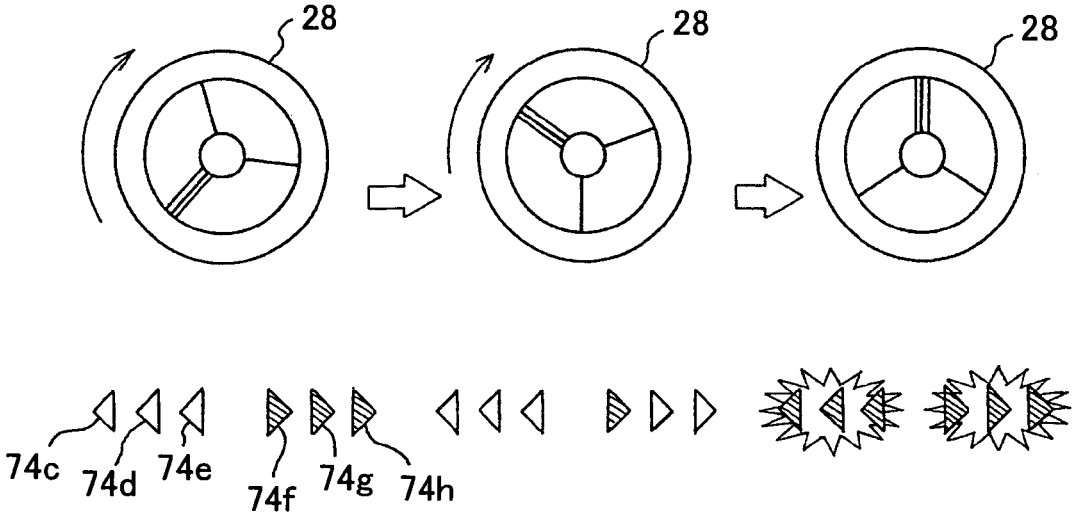
FIG. 12 are a set of views similar to FIG. 11 but showing the informing operation by an indicator among the operation of an outboard motor steering control system according to a second embodiment of the invention.

The operation differs from that of the first embodiment in the execution of S18 of the flowchart of FIG. 8, i.e., the step in which the phase difference elimination control is performed and the boat operator is kept informed of the phase difference. Specifically, as shown in FIG. 12A, when a phase difference is present, the lamps on the side of the phase difference, the right lamps 74*f*, 74*g*, 74*h* in the illustrated example, are lit in a number that increases with increasing phase difference magnitude. As shown in FIG. 12B, the number of lit lamps is reduced as the phase difference decreases, and as shown in FIG. 12C, all lamps on both the right and left are lit when the phase difference is eliminated.

Thus the outboard motor steering control system according to the second embodiment comprises the six (a plurality of) lamps 74*c* to 74*h* (indicators) that light to keep the boat operator continually informed of the direction and magnitude of the phase difference. Since this feature enables the boat operator to keep a constant eye on the direction and magnitude of the phase difference by observing a visual display, the phase difference can be eliminated without giving the boat operator an unnatural feel.

Figure 9:
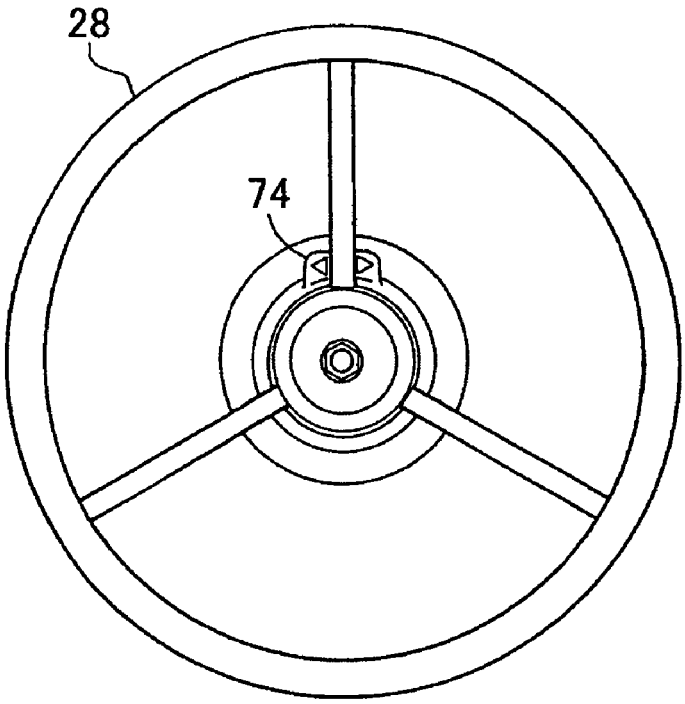
FIG. 9 is an explanatory view showing an indicator installed near the steering wheel shown in FIG. 1.
Figure 10:
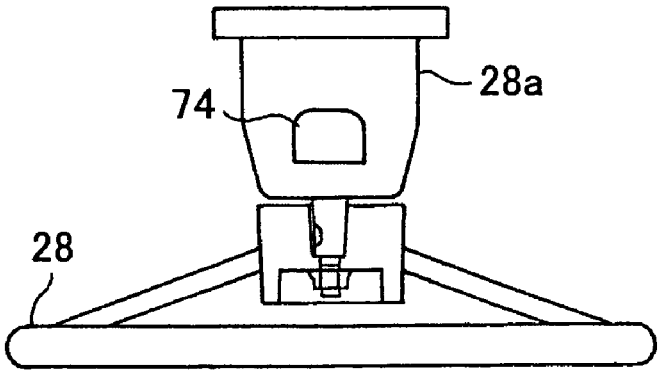
FIG. 10 is an explanatory view similarly showing the indicator installed near the steering wheel shown in FIG. 1.
Figure 13:
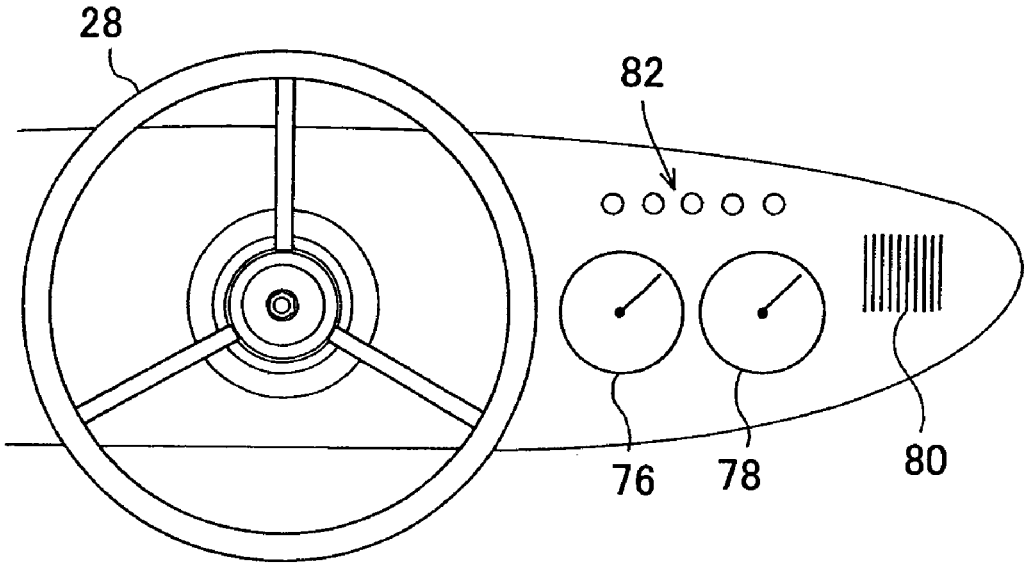
FIG. 13 is an explanatory view similar to FIG. 9 but showing a buzzer used in the informing operation of an outboard motor steering control system according to a third embodiment of the invention.

FIG. 13 is an explanatory view, similar to FIG. 9, showing an outboard motor steering control system according to a third embodiment of this invention, with focus on the use of an indicator for keeping the boat operator informed.

As shown in the drawing, the dashboard at the cockpit where the steering wheel 28 is installed is ordinarily provided with a tachometer 76, speedometer (boat speed indicator) 78 and buzzer (medium of sound) 80. In the third embodiment, processing is performed in S18 of the flowchart of FIG. 9 of the first embodiment for implementing the phase difference elimination control and using the buzzer 80 to keep the boat operator continually informed of the direction and magnitude of the phase difference.

Specifically, the buzzer 80 is intermittently sounded at shorter intervals with increasing magnitude of the phase difference and is sounded at longer intervals with decreasing magnitude of the phase difference. When the phase difference is eliminated, the buzzer 80 is sounded continuously for a predetermined period.

Instead of varying the sounding interval, it is possible to vary the tone or pitch of the buzzer. In addition, two among the sounding interval, tone and pitch can be combined to additionally inform the boat operator of the side (direction) of the phase difference. It is also possible to replace the buzzer 80 with a speaker and provide the information by voice.

The outboard motor steering control system according to the third embodiment is configured to keep the boat operator continually informed of the phase difference by sounding (operating) at least one buzzer (audible means). Since this feature enables the boat operator to keep constantly informed of the phase difference through the medium of sound, the phase difference can be eliminated without giving the boat operator an unnatural feel.

The present exemplary embodiments are thus configured to have a system for controlling steering an outboard motor (10) adapted to be mounted on a stem of a boat (16) and having an internal combustion engine (18) that powers a propeller (24), comprising: a steering wheel (28) installed at a cockpit of the boat to be turned by an operator; an actuator (steering hydraulic cylinder 40) that rotates the outboard motor about a steering shaft (swivel shaft 50) in response to turning of the steering wheel such that the outboard motor is steered relative to the boat; a steering wheel angle sensor (30) which produces an output indicative of a turned angle of the steering wheel; a rotation angle sensor (44) which produces an output indicative of a rotation angle of the steering shaft; and a controller (ECU 22; S10 to S18) which compares the outputs of the steering wheel angle sensor and the rotation angle sensor to determine whether there is a phase difference in steering angle when the engine (18) is started, controls operation of the actuator so as to eliminate the difference, if the phase difference is found, when the operator turns the steering wheel (28), and informing the operator of the phase difference.

In the system, the controller continues to inform the operator of at least one of magnitude and direction of the phase difference.

In the system, the controller continues to inform the operator of the phase difference through an indicator (lamps 74*a* to 74*h* ).

In the system, the controller continues to inform the operator of the phase difference by blinking the indicator (lamps 74*a*, 74*b* ).

In the system, the controller continues to inform the operator of the phase difference by changing number of the indicators (lamps 74*c* to 74*h* ) to be lit.

In the system, the controller continues to inform the operator of the phase difference through a medium of sound (buzzer 80).

It has been explained that the boat operator is informed of the direction and/or magnitude of the phase difference by use of the lamp 74*a* or other such notification means. However, the notification is not limited to those set out in the foregoing. For example, when the oil pressure of hydraulic damper 72 is variably controlled, the information can be conveyed to the boat operator by varying the oil pressure. In addition, the tachometer 76 or speedometer 78 can be briefly redirected for use as a phase difference notification means. Still another possibility is to utilize warning lamps 82 ordinarily provided on the dashboard as shown in FIG. 13.

Although a hydraulic cylinder has been exemplified as the actuator for rotating the swivel shaft 50, this is not a limitation and it is possible instead to use an electric motor or hydraulic motor. Moreover, a configuration can be adopted in which the boat operator manually eliminates the phase difference after being informed thereof.

While the invention has thus been shown and described with reference to specific exemplary embodiments, it should be noted that the invention is in no way limited to the details of the described arrangements; changes and modifications may be made without departing from the scope of the appended claims.

What is claimed is:

1. A system for controlling steering of an outboard motor adapted to be mounted on a stern of a boat and having an internal combustion engine that powers a propeller, comprising:

a steering wheel installed at a cockpit of the boat to be turned by an operator;

an actuator which rotates the outboard motor about a steering shaft in response to turning of the steering wheel such that the outboard motor is steered relative to the boat;

a steering wheel angle sensor which produces an output indicative of a turned angle of the steering wheel;

a rotation angle sensor which produces an output indicative of a rotation angle of the steering shaft; and a controller which compares the outputs of the steering wheel angle sensor and the rotation angle sensor to determine whether there is a phase difference in steering angle when the engine is started, controls operation of the actuator so as to eliminate the difference, if the phase difference is found, only when the operator turns the steering wheel, and simultaneously informs the operator of the phase difference.

2. The system according to claim 1, wherein the controller continues to inform the operator of a status of at least one of magnitude and direction of the phase difference until the phase difference is eliminated.

3. The system according to claim 1, wherein the controller continues to inform the operator of the phase difference through an indicator which is disposed in a vicinity of the steering wheel.

4. The system according to claim 3, wherein the controller continues to inform the operator of the phase difference by blinking the indicator.

5. The system according to claim 3, wherein the controller continues to inform the operator of the phase difference by changing number of the indicators to be lit.

6. The system according to claim 1, wherein the controller continues to inform the operator of the phase difference through a medium of sound which is disposed in a vicinity of the steering wheel.

7. A method of controlling steering of an outboard motor adapted to be mounted on a stem of a boat and having an internal combustion engine that powers a propeller, a steering wheel installed at a cockpit of the boat to be turned by an operator;

an actuator that rotates the outboard motor about a steering shaft in response to turning of the steering wheel such that the outboard motor is steered relative to the boat;

a steering wheel angle sensor which produces an output indicative of a turned angle of the steering wheel; and a rotation angle sensor which produces an output indicative of a rotation angle of the steering shaft, comprising the steps of:

comparing the outputs of the steering wheel angle sensor and the rotation angle sensor to determine whether there is a phase difference in steering angle when the engine is started;

controlling operation of the actuator so as to eliminate the difference, if the phase difference is found, only when the operator turns the steering wheel; and simultaneously informing the operator of the phase difference.

8. The method according to claim 7, wherein the step of informing involving continuing to inform the operator of a status of at least one of magnitude and direction of the phase difference until the phase difference is eliminated.

9. The method according to claim 7, wherein the step of informing involving continuing to inform the operator of the phase difference through an indicator which is disposed in a vicinity of the steering wheel.

10. The method according to claim 9, wherein the step of informing involving continuing to inform the operator of the phase difference by blinking the indicator.

11. The method according to claim 9, wherein the step of informing involving continuing to inform the operator of the phase difference by changing number of the indicators to be lit.

12. The method according to claim 7, wherein the step of informing involving continuing to inform the operator of the phase difference through a medium of sound which is disposed in a vicinity of the steering wheel.

* * * * *